US009295611B2

(12) United States Patent
Lamberson

(10) Patent No.: US 9,295,611 B2
(45) Date of Patent: Mar. 29, 2016

(54) PORTABLE SPA INSULATION METHOD AND APPARATUS

(75) Inventor: Roger E. Lamberson, San Diego, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 581 days.

(21) Appl. No.: 13/547,744

(22) Filed: Jul. 12, 2012

(65) Prior Publication Data

US 2013/0019393 A1 Jan. 24, 2013

Related U.S. Application Data

(60) Provisional application No. 61/510,957, filed on Jul. 22, 2011.

(51) Int. Cl.

| | |
|---|---|
| ***A47K 3/02*** | (2006.01) |
| ***A61H 33/00*** | (2006.01) |
| ***E04H 4/00*** | (2006.01) |
| *E04F 21/06* | (2006.01) |

(52) U.S. Cl.

CPC ..... *A61H 33/6005* (2013.01); *E04H 4/0043* (2013.01); *A61H 2201/0157* (2013.01); *E04F 21/06* (2013.01); *Y10T 29/49826* (2015.01)

(58) Field of Classification Search

CPC ..... A47K 3/02
USPC ..... 4/538–595
See application file for complete search history.

(56) References Cited

U.S. PATENT DOCUMENTS

| | | | | |
|---|---|---|---|---|
| 2,044,221 | A * | 6/1936 | Myers et al. | 55/483 |
| 2,672,323 | A * | 3/1954 | Larson | 165/136 |
| 2,907,408 | A * | 10/1959 | Engle et al. | 55/500 |
| 2,938,448 | A * | 5/1960 | Gacki | 137/571 |
| 3,084,402 | A * | 4/1963 | Jordan, Jr. et al. | 52/145 |
| 3,108,706 | A * | 10/1963 | Matsch et al. | 220/592.11 |
| 3,130,719 | A * | 4/1964 | Mayer et al. | 126/37 B |
| 3,159,235 | A * | 12/1964 | Young et al. | 52/404.5 |
| 3,216,459 | A * | 11/1965 | Schroeder et al. | 138/139 |
| 4,177,618 | A * | 12/1979 | Felter | 52/742.13 |
| 4,829,738 | A | 5/1989 | Moss | |
| 6,243,889 | B1 * | 6/2001 | Ducharme et al. | 4/545 |

(Continued)

FOREIGN PATENT DOCUMENTS

| | | | |
|---|---|---|---|
| JP | 2000355074 | A | 12/2000 |
| JP | 2008092965 | | 4/2008 |
| JP | 2008092965 | A | 4/2008 |
| KR | 20070005467 | A | 1/2007 |
| WO | 94/10401 | | 5/1994 |

(Continued)

OTHER PUBLICATIONS

PCT International Search Report and Written Opinion, completed on Jan. 31, 2013; mailed from Korean Intellectual Property Office on Feb. 1, 2013.

(Continued)

*Primary Examiner* — Lori Baker

(74) *Attorney, Agent, or Firm* — Lapple Ubell IP Law, LLP; Franklin Ubell

(57) ABSTRACT

An uninsulated portable spa unit is inverted, and a seal plate having a flat interior surface and a plurality of doors is lowered onto the bottom surface of the inverted spa. The doors are successively opened and glass wool installation apparatus is successively inserted through the door openings and operated to install glass wool insulation into the interior of the spa unit.

30 Claims, 14 Drawing Sheets

(56) References Cited

U.S. PATENT DOCUMENTS

| | | | | |
|---|---|---|---|---|
| 7,662,221 | B2 | 2/2010 | Fay | |
| 7,735,755 | B2 | 6/2010 | Near | |
| 8,322,111 | B2 * | 12/2012 | Near et al. | 52/741.4 |
| 8,711,542 | B2 * | 4/2014 | Fellinger | 361/220 |
| 2004/0013848 | A1 * | 1/2004 | Kobayashi et al. | 428/85 |
| 2011/0131722 | A1 * | 6/2011 | Scott et al. | 4/584 |

FOREIGN PATENT DOCUMENTS

| | | | | |
|---|---|---|---|---|
| WO | WO 9410401 | A1 * | 5/1994 | E04B 1/76 |

OTHER PUBLICATIONS

European Patent Office, Extended European Search Report with Supplementary European Search Report for Application No. 12818082.5, dated Feb. 25, 2015. (7 pages).

* cited by examiner

PORTABLE SPA INSULATION METHOD AND APPARATUS

CROSS REFERENCE TO RELATED APPLICATIONS

This application claims the benefit of and priority to U.S. Provisional Application Ser. No. 61/510,957, filed Jul. 22, 2011, entitled "Portable Spa Insulation," the contents of which is incorporated by reference herein in its entirety.

BACKGROUND OF THE INVENTION

1. Field of Invention

The subject disclosure relates to portable spa construction and, more particularly, to a portable spa with improved insulation.

2. Related Art

Portable spas have become quite popular as a result of their ease of use and multiplicity of features such as varied jet and seating configurations. One area where the inventor has recognized that improvement would be desirable concerns the methods and apparatus used to insulate the spa.

SUMMARY

According to an illustrative embodiment, glass wool insulation is utilized to replace all or part of the conventional two part rigid polyurethane foam spa insulation. An illustrative method of insulating a portable spa may comprise inverting an uninsulated spa, providing a seal plate comprising a flat interior surface having at least one openable door positioned therein, lowering the sealing plate onto the bottom surface of the inverted spa, opening the door, inserting a glass wool installation apparatus into the door opening, and operating the installation apparatus to install glass wool insulation into the interior of the spa.

DETAILED DESCRIPTION

According to illustrative embodiments, glass wool insulation is utilized to replace all or part of conventional two part rigid polyurethane foam spa insulation. The glass wool may be, for example, the JM Spider spray-in fiberglass insulation product available from John Manville, Denver, Colo. Anti-static silicone may be added to the John Manville formula in order to eliminate static and prevent the glass wool from wicking up moisture.

Figure 1:
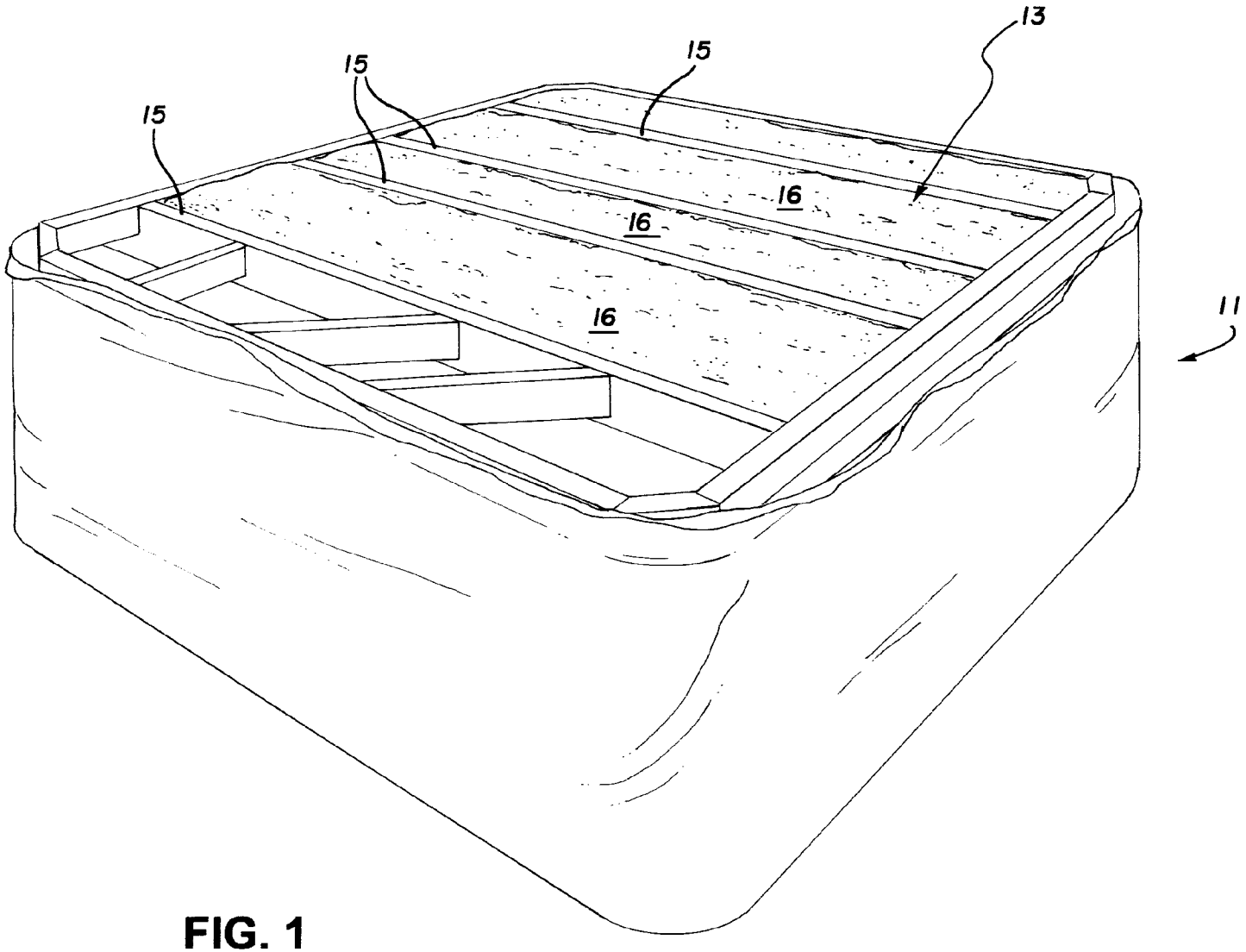
FIG. 1 is a perspective view of a portable spa placed upside down with glass wool insulation installed in the interior thereof.
Figure 2:
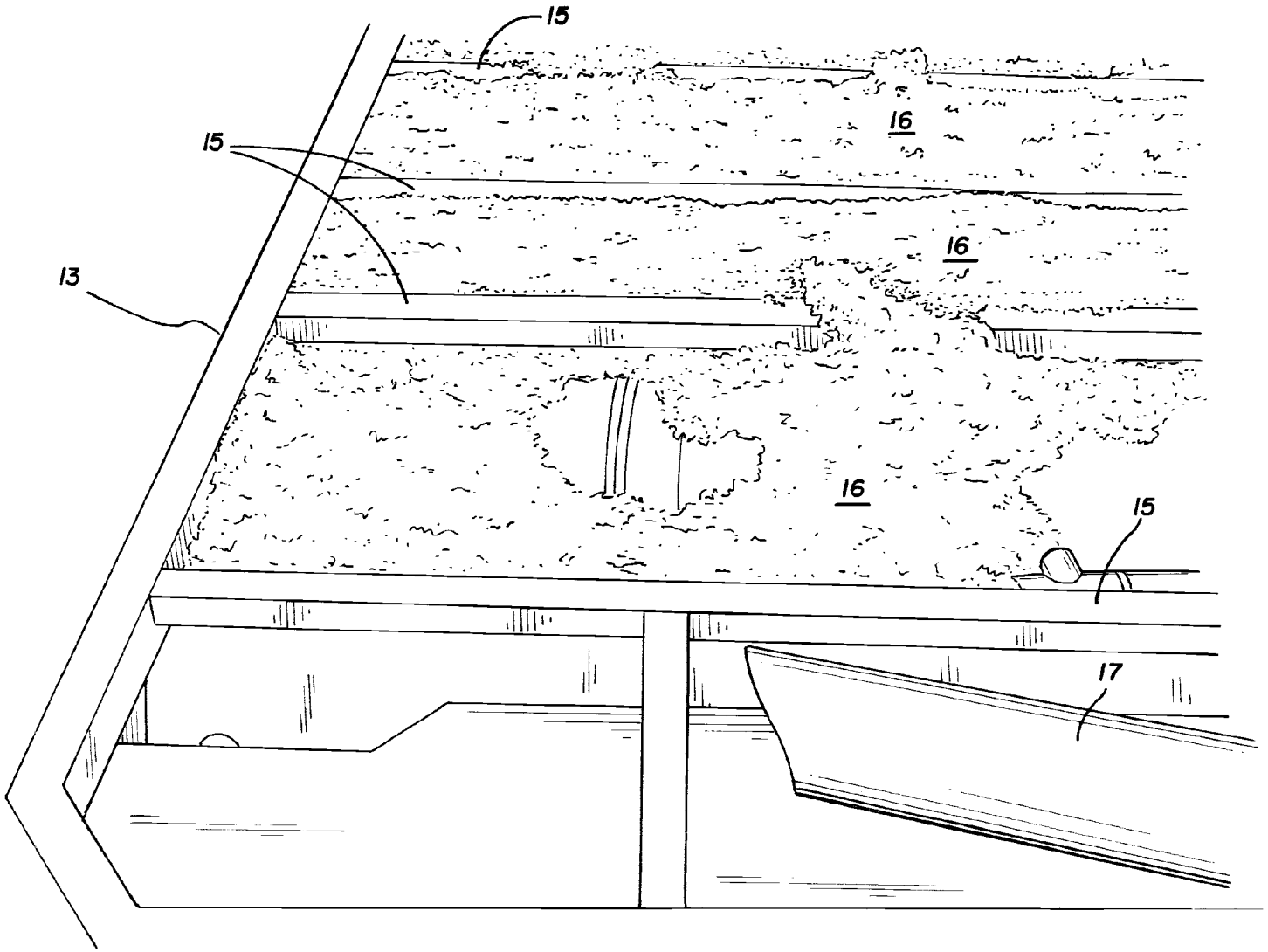
FIG. 2 is a perspective view and further illustrating a blower installation tube.
Figure 3:
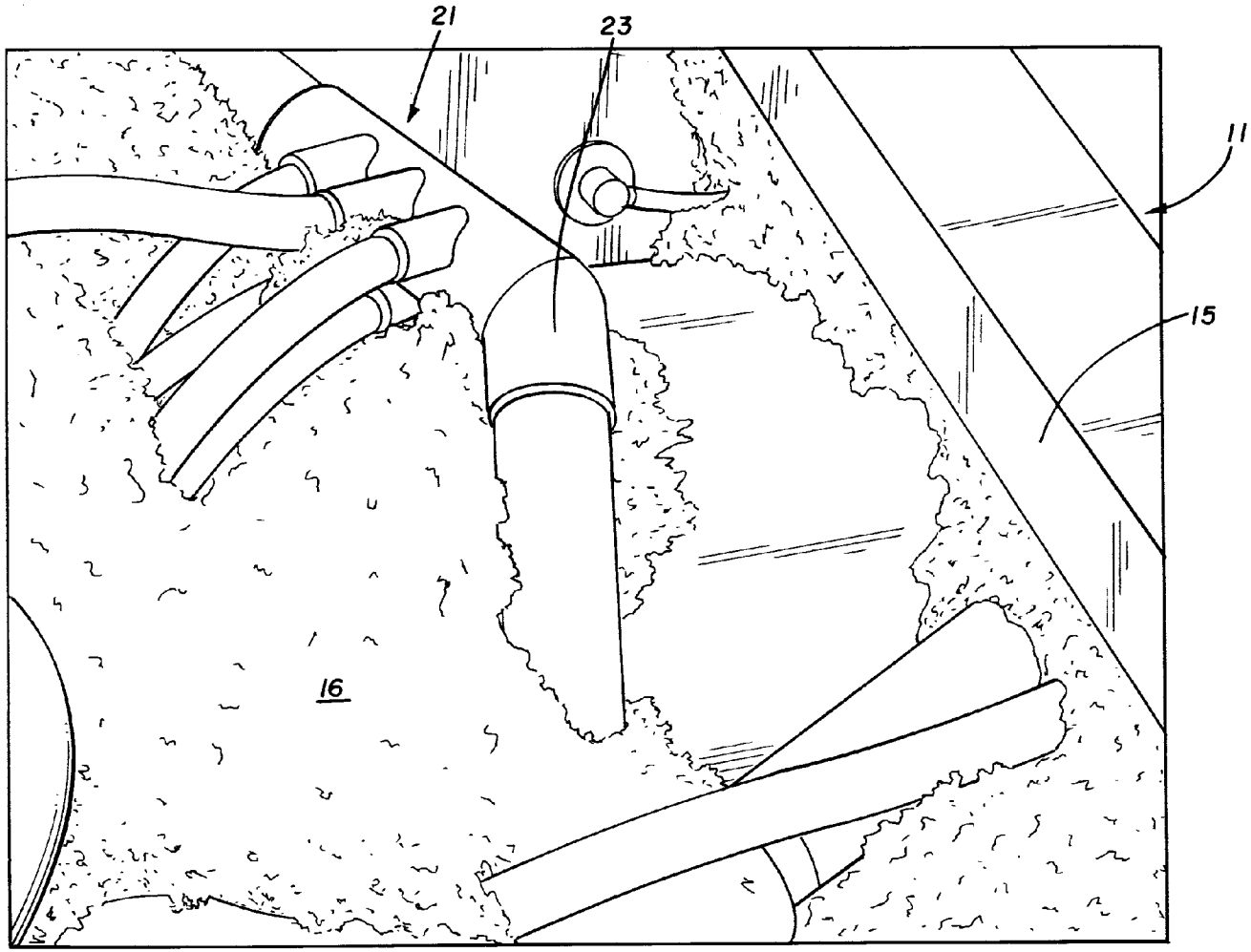
FIG. 3 is a partial perspective view of an interior portion of a portable spa wherein previously installed glass wool insulation has been partially removed to expose interior spa piping.

In a first illustrative embodiment, a spa is positioned with its bottom end 13 up, for example, as shown in FIGS. 1-3. A cloth or other cover may be placed over the bottom 13 of the spa 11 and fixed in position, for example, across the parallel wooden bottom rails 15. A glass wool spraying tube 17 (FIG. 2) may be then inserted through the cloth and the glass wool 16 blown into the spa interior through the tube 17. In a production embodiment, a reusable fixture may be constructed and used to cover the spa bottom 13 during the process of blowing the glass wool 16 into the spa interior. FIG. 1 illustrates the spa 11 after insulation has been blown into several of the interior regions or cavities beneath the parallel horizontal bottom frame members or rails 15. An advantage over rigid polyurethane foam is that the glass wool 16 may be removed in the field to facilitate repair and then replaced. FIG. 3 illustrates an area 21 where glass wool 16 has been removed to expose interior spa water piping 23.

Figure 4:
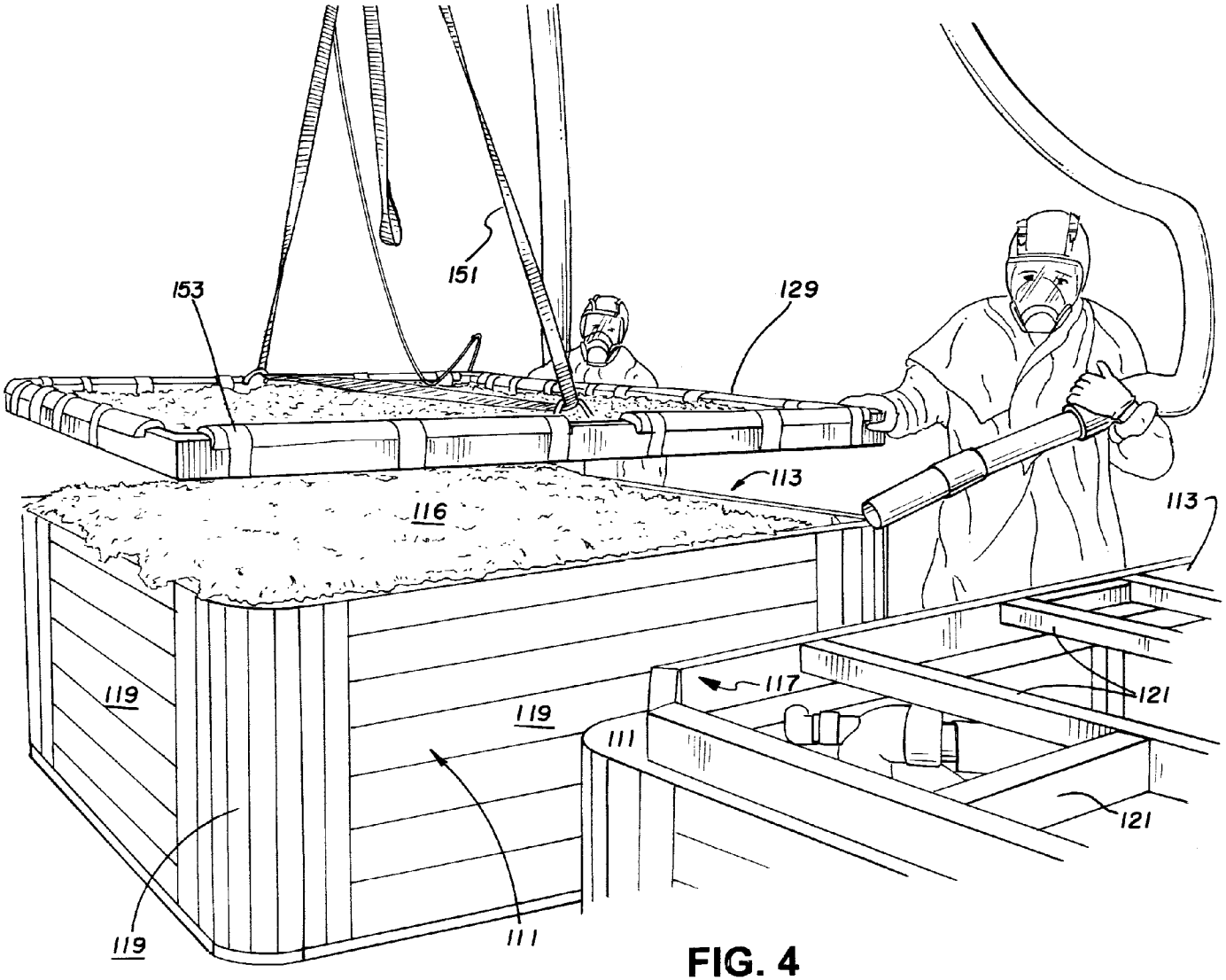
FIG. 4 is a perspective view illustrating apparatus employed in an illustrative embodiment to install glass wool insulation in a portable spa unit.

According to a second illustrative embodiment illustrated in FIGS. 4-14, a spa 111 ready for insulation installment is placed upside down resting on its top rim so that glass wool insulation may be shot into it from its under or bottom side 113. Typically, the spa 111 at this stage will comprise a spa shell 115 (FIG. 5) attached to a surrounding frame 117 with exterior paneling 119 attached to the frame 117 and with all spa equipment such as pump, filter, heater, jets, and controls installed. The surrounding frame 117 may include, for example, a base frame, formed for example of perpendicularly or rectangularly arranged wooded studs 121 as shown in FIG. 4. The spa will also typically include a "firewall" 123 (FIG. 6), which, in one embodiment, may be a sheet of black corrugated polypropylene that separates the equipment compartment of the spa from the tub area, similar to the firewall in a car. Such a sheet 123 may be cut on a Numerical Controlled (NC) Router to the proper shape and to create holes, e.g. 124, for the plumbing pipes, e.g. 125 (FIG. 5), and electronics to pass through.

Figure 5:
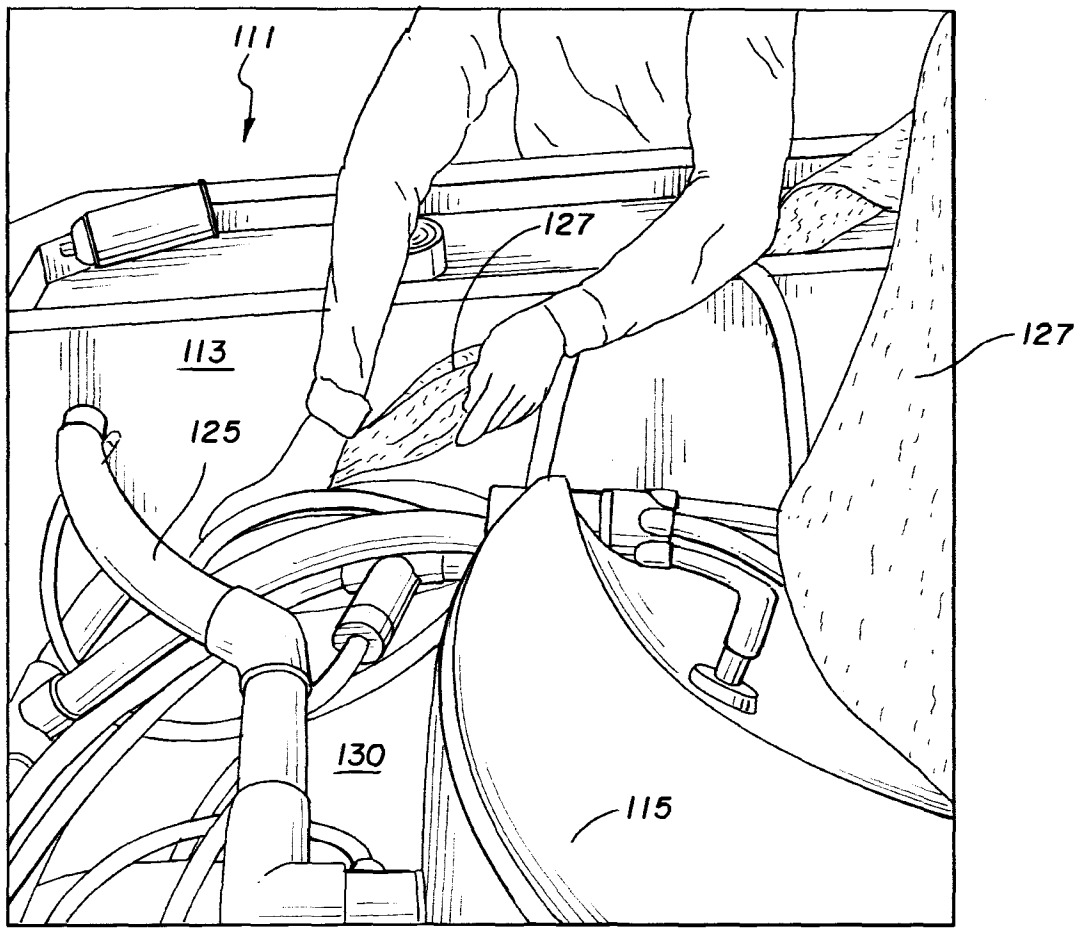
FIG. 5 is a perspective view illustrating installation of batting material prior to blowing glass wool insulation into interior cavities of a portable spa.
Figure 6:
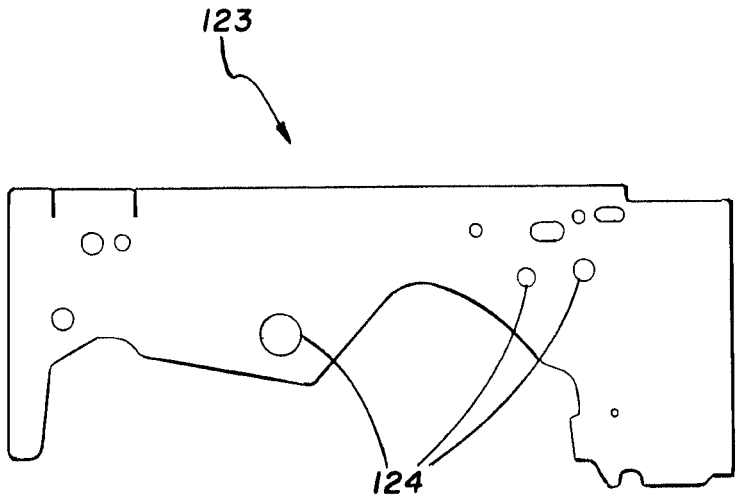
FIG. 6 illustrates a typical spa firewall.
Figure 7:
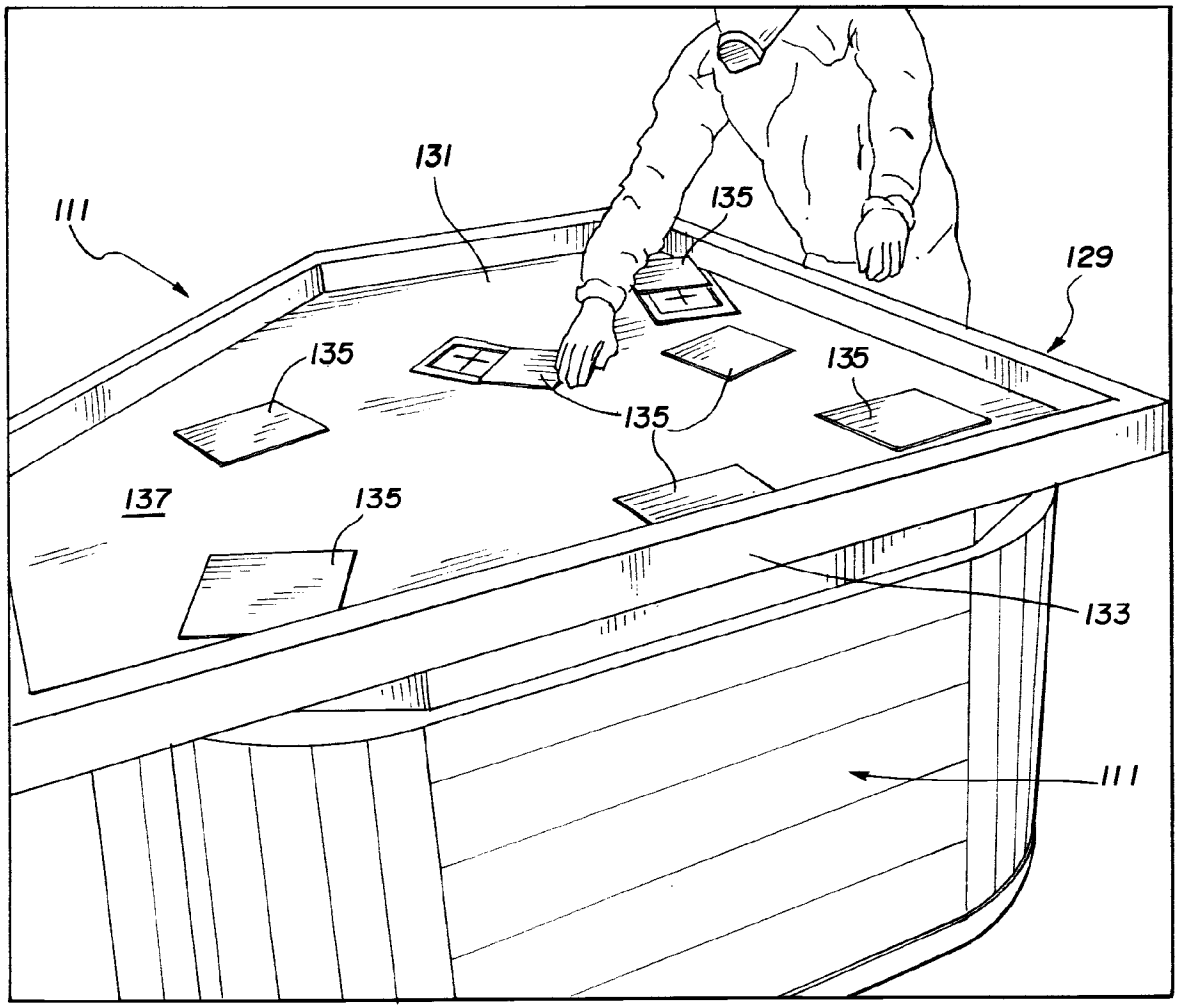
FIG. 7 is a perspective view illustrating opening of doors of a spa sealing plate according to an illustrative embodiment.
Figure 8:
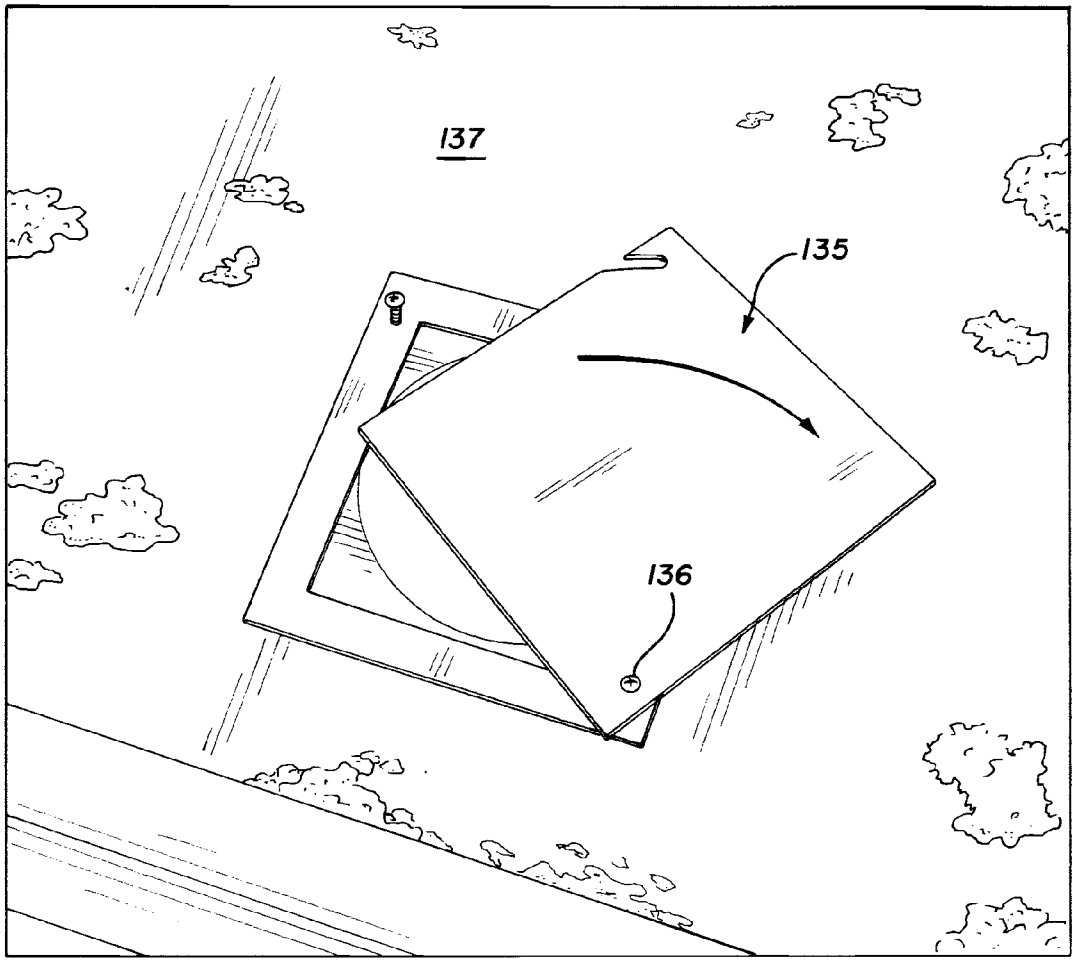
FIG. 8 is a perspective view illustrating operation of an illustrative door embodiment.
Figure 9:
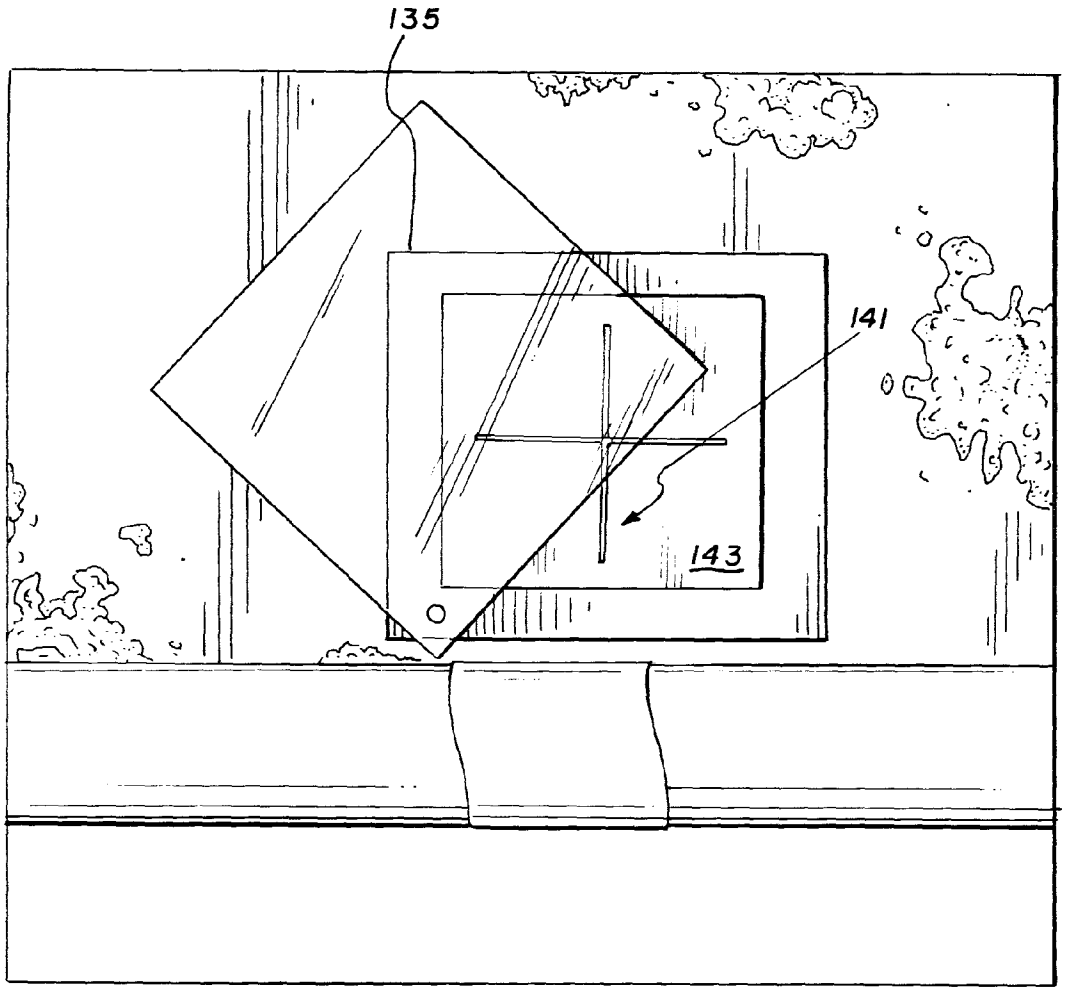
FIG. 9 is a perspective view of an illustrative embodiment of a spa door opening in an illustrative seal plate structure.

In a first step according to an illustrative process, illustrated in FIG. 5, suitable batting material 127, for example, such as polyester batting, is installed to block the firewall openings and other openings as necessary or desirable. A spray adhesive may be used to secure the batting in place. Additionally, if desired, masking tape may be used to block other small openings, and Kraft paper or other shielding may be placed around the spa exterior to protect decorative paneling 119.

In a next step, a sealing plate 129, shown e.g. FIGS. 4 and 7-9, is installed by lowering it onto the spa frame members 121. In one embodiment, this sealing plate 129 is fabricated from a flat interior sheet 131 surrounded by a rim 133. In one embodiment, the flat sheet 131 may be attached to the rim 133 by screws or other fasteners. In one embodiment, the flat sheet 131 may be wood, such as plywood, or fiberglass, and the rim 133 may be a metal, such as, for example, aluminum. The shape of the sealing plate 129 is selected to conform to the shape of the spa bottom in illustrative embodiments.

A number of hinged doors or door "sliders" 135 are positioned on the top surface 137 of the flat sheet 131. Each hinged door 135 is strategically positioned at a location where it is desired to inject the insulative glass wool material. In one embodiment, the doors 135 are positioned to be over the deeper parts of the spa interior in order to allow optimum filling of the spa 111.

In one embodiment, a plate lifter 151, e.g., FIG. 4, comprising, for example, a chain hoist with wheels riding on a ceiling I beam or other track, may be used to suspend, mechanically lift, move and position a larger sealing plate 129, while smaller sealing plates 129 may be handled manually. The sealing plate 129 may be placed in an initial position above the spa 111 and then aligned. In one embodiment, the alignment is by reference to locating the doors 135 over the deeper parts of the spa 111, as mentioned above. In one embodiment shown in FIGS. 8 and 9, a door 135 is hinged by a screw or other device 136 to pivot in the plane of the top surface 137 to reveal a rectangular opening 141 wherein is disposed a rectangular shield or membrane 143 with an "X" or other opening cut or otherwise formed in it. In one embodiment, the flexible shield 143 may be fabricated of rubber or a flexible plastic material.

Figure 10:
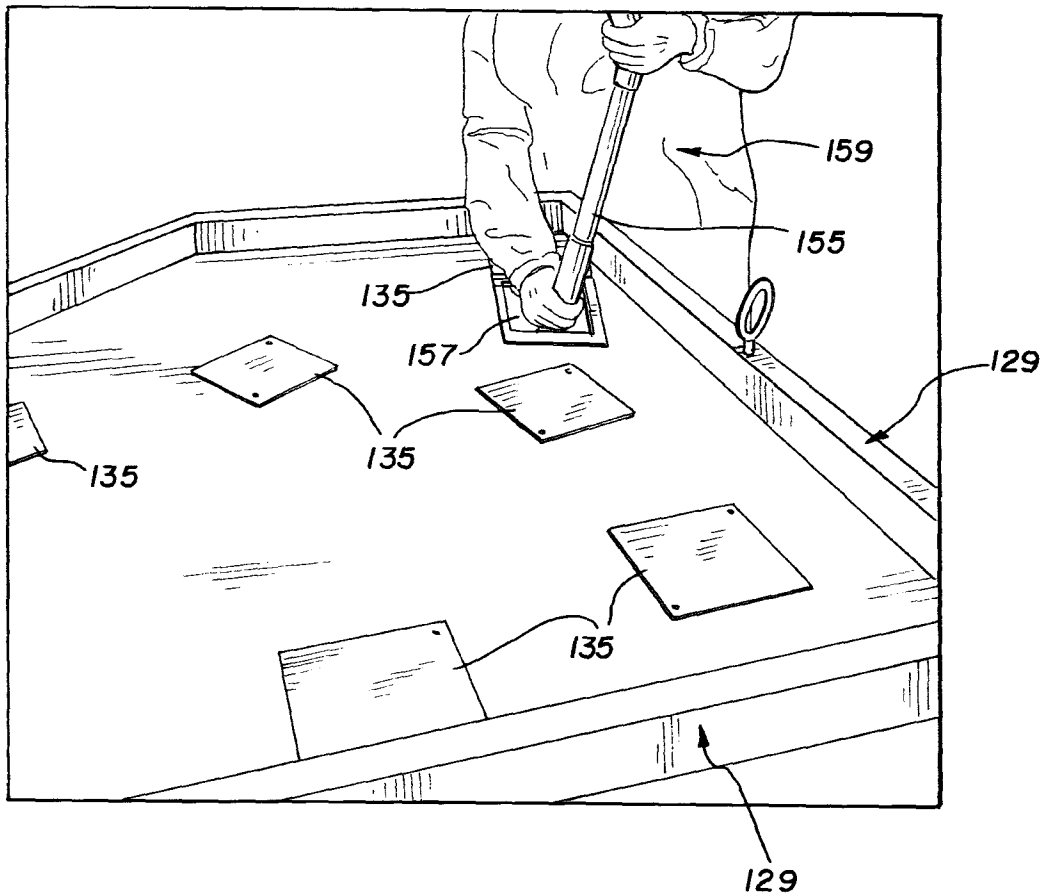
FIG. 10 is a perspective view illustrating positioning of a blower tube in a spa door opening for purposes of blowing glass wool insulation into an interior cavity of the spa.

Once the sealing plate 129 is in place, one of the hinged doors 135 is opened and a blower tube 155 is inserted into the opening 157 above an internal spa cavity to be filled, for example, as illustrated in FIG. 10. The operator 159 may then employ manual assistance from other workers to hold the seal plate 127 in place against the spa unit's frame members, e.g. 121. Of course, mechanical means may be provided in other embodiments to hold the seal plate 129 in place. Once the area beneath the blower tube 155 is visually detected to be filled, the blower 155 is turned off, and then another seal plate door 135 is opened, the blower tube 155 inserted, and the area beneath the tube 155 filled. This process is repeated for all the seal plate doors 135 until the spa's internal cavity or cavities, e.g., 130, are completely filled.

Figure 11:
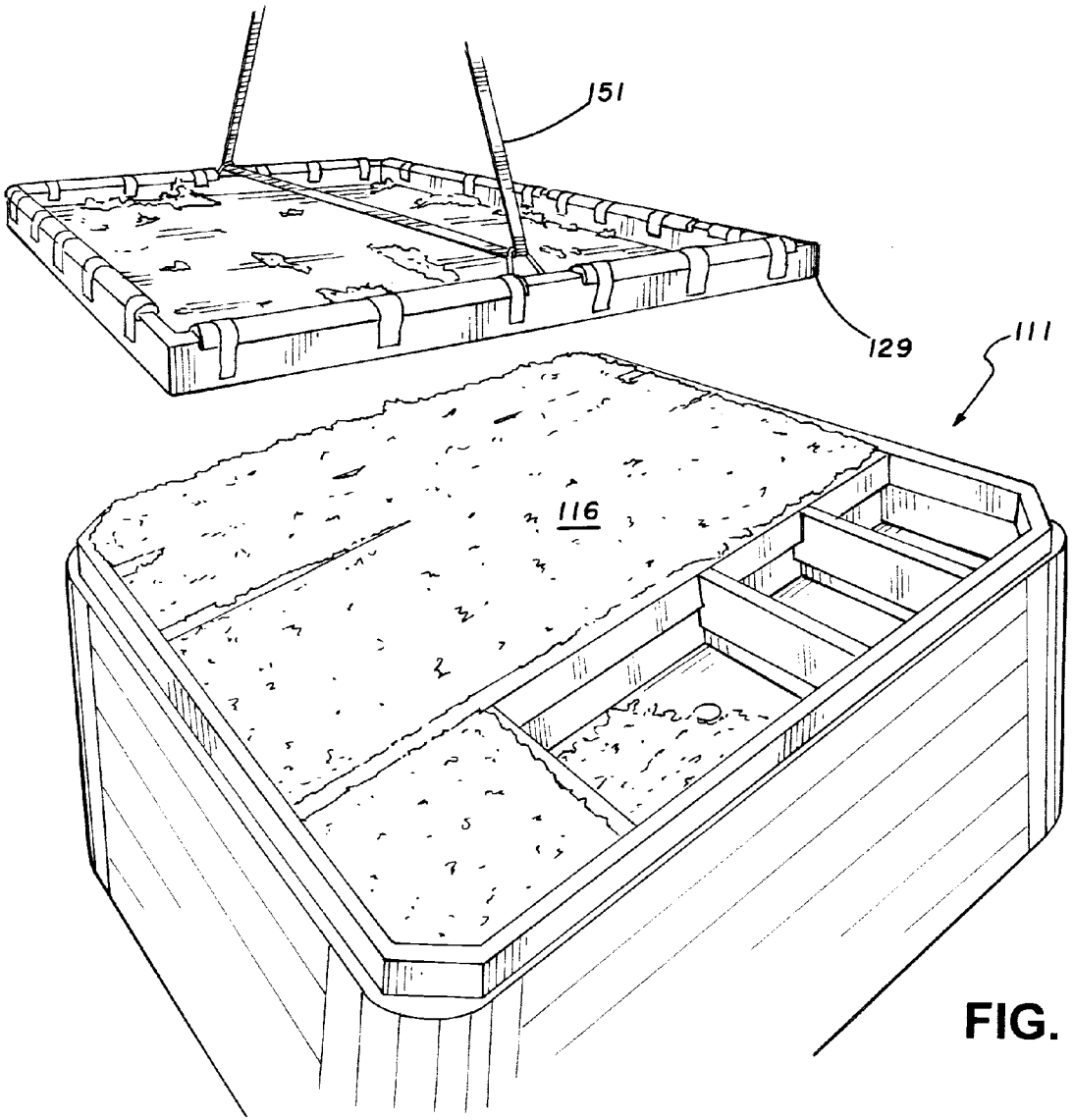
FIG. 11 is a perspective view illustrating removal of a spa sealing plate after installation of glass wool insulation into the interior cavity of a portable spa unit.
Figure 12:
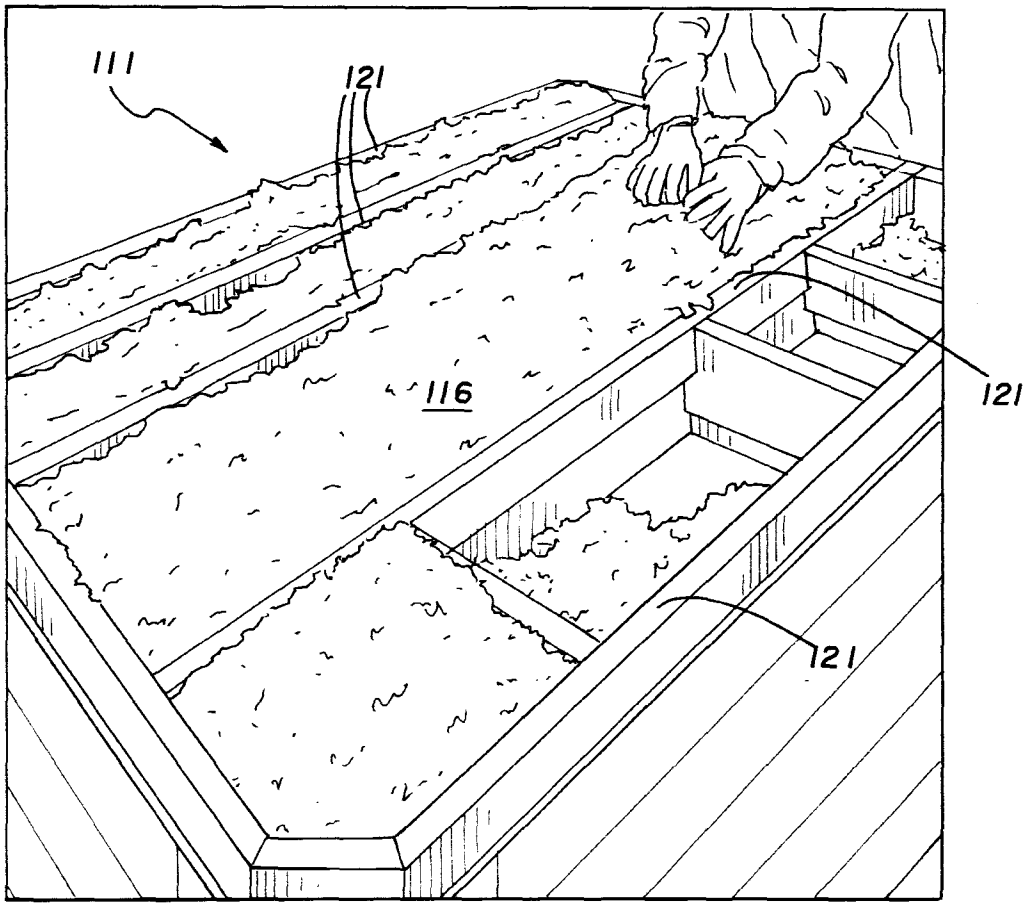
FIG. 12 is a perspective view illustrating packing down of glass wool insulation into a spa interior after removal of the spa sealing plate.

After filling, the seal plate 129 is removed, revealing the "filled" spa unit 111 as shown in FIGS. 4 and 11-12. The glass wool insulation 116 is then packed, pushed or tamped down by hand approximately one half inch, as shown in FIG. 12. Any excess glass wool 116 is removed from the intake and exhaust cavities, which are the intakes for cool air to the spa's pumps and exhausts for heat from the pumps. Glass wool 116 is also removed from the top surface area of the frame member studs 121. Any excess glass wool is also blown from the spa equipment compartment area utilizing, for example, an air hose and subsequent vacuuming.

Figure 13:
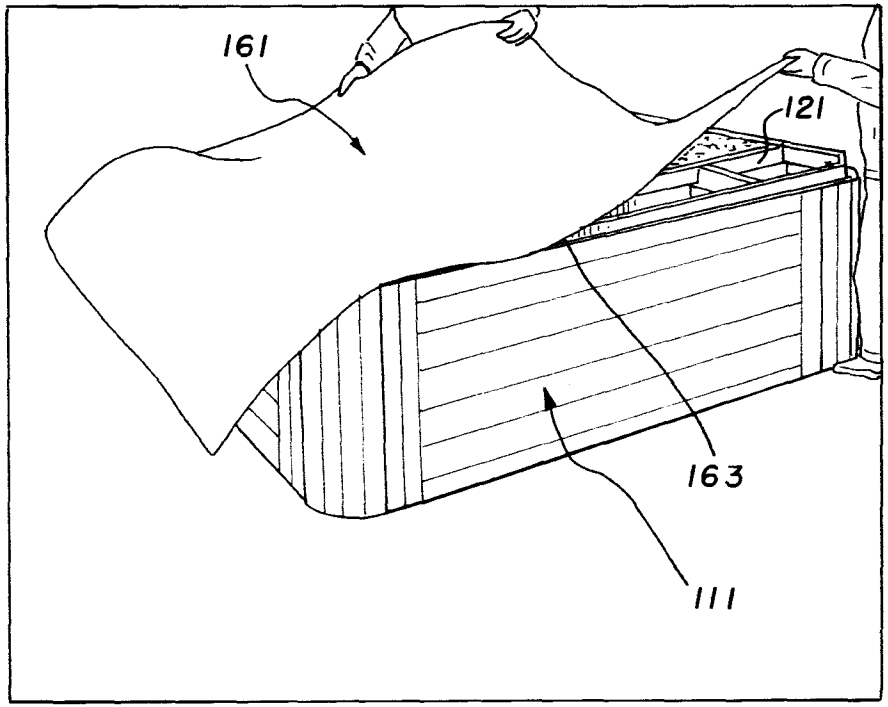
FIGS. 13 and 14 are perspective views illustrating attachment of a plastic bottom sheet after packing down of the glass wool insulation.
Figure 14:
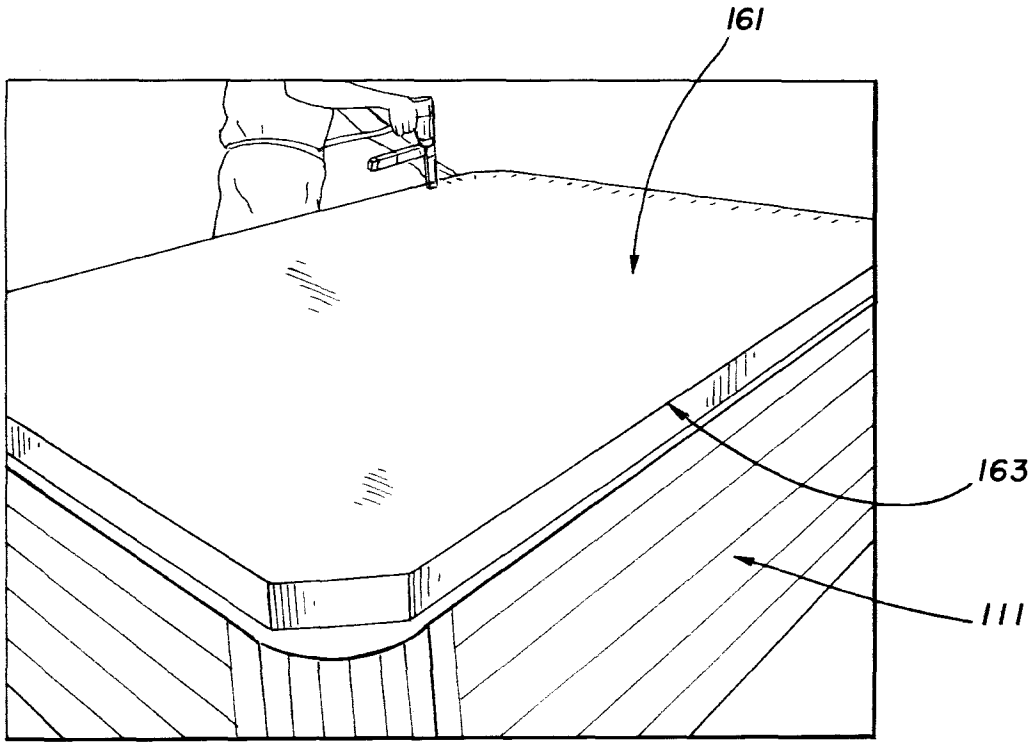

As shown in FIGS. 13 and 14, a sheet of plastic 161 is next placed onto the pedestal frame, centered and stapled at its edges 163 flush with the pedestal edge. In illustrative embodiments, the plastic sheet 161 may be either ABS or Polyethylene. The plastic sheet 161 seals the bottom of the spa 111 so that the glass wool insulation will not fall out. Any excess plastic around the edges 163 of the spa 111 may be trimmed off using a router or other tool.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A method of insulating a portable spa, the spa comprising a spa shell, framing around the shell, and spa equipment installed within the framing, the method comprising:

inverting the portable spa to expose an open bottom surface thereof;

providing a sealing plate comprising a flat interior surface having at least one pivotally mounted openable door positioned therein, the sealing plate being configured to lie adjacent a space in said interior into which glass wool is to be installed;

lowering said sealing plate onto the open bottom surface of the inverted spa;

opening said at least one door;

inserting a glass wool installation apparatus into an opening revealed when said door is opened; and employing said apparatus to install glass wool insulation into the interior of said portable spa;

wherein said sealing plate confines the glass wool insulation to the interior of the portable spa during installation of the glass wool.

2. The method of claim 1 wherein said sealing plate has a plurality of doors selectively positioned over selected interior cavities of said spa.

3. The method of claim 1 further comprising placing a bottom sheet over the spa bottom after the glass wool insulation has been installed to retain the installed glass wool in place.

4. The method of claim 3 further comprising installing batting material to seal selected openings in the interior of the spa structure prior to lowering said sealing plate onto said bottom surface.

5. The method of claim 4 wherein said sealing plate has a plurality of doors selectively positioned above selected interior cavities of said spa.

6. The method of claim 5 wherein the selected openings sealed by said batting material prior to lowering said sealing plate comprise firewall openings.

7. The method of claim 6 wherein a said openable door is opened by pivoting it in a plane parallel to that of a horizontal sealing plate surface.

8. The apparatus of claim 6 wherein said glass wool insulation is removable and replaceable in order to facilitate repair of spa componentry.

9. Apparatus comprising:

a portable spa having a spa shell, framing around the shell, and spa equipment installed within said framing;

insulation applied within the framing in the interior of the spa and about the spa equipment, the insulation comprising removable sprayed-in glass wool; and a cover attached to the bottom of the spa and configured to hold the sprayed-in glass wool in place in the interior of the spa.

10. A portable spa constructed by a process comprising:

inverting a portable spa structure;

providing a sealing plate comprising a flat interior surface having at least one pivotally mounted openable door positioned therein;

lowering said sealing plate onto an open bottom surface of the inverted spa;

opening said at least one door;

inserting a glass wool installation apparatus into an opening revealed when said door is opened; and employing said apparatus to install glass wool insulation into the interior of said portable spa structure.

11. The portable spa of claim 10 wherein the sealing plate used in said process has a plurality of doors selectively positioned above selected interior cavities of said spa.

12. The portable spa of claim 10 wherein said process further comprises placing a bottom sheet over the spa bottom after the glass wool insulation has been installed to retain the installed glass wool in place.

13. The portable spa of claim 12, wherein said process further comprises installing batting material to seal selected openings in the interior of the spa structure prior to lowering said sealing plate onto said bottom surface.

14. The portable spa of claim 13 wherein the sealing plate used in said process has a plurality of doors selectively positioned above selected interior cavities of said spa.

15. The portable spa of claim 14 wherein the selected openings sealed by said batting material comprise firewall openings.

16. The portable spa of claim 15 wherein, in said process, a said openable door is opened by pivoting it in a plane parallel to that of a horizontal sealing plate surface.

17. A portable spa constructed by a process comprising:

inverting a portable spa structure having an open bottom surface;

providing a cover configured to cover said open bottom surface and having at least one opening therein;

inserting a glass wool spraying apparatus into said opening; and employing said apparatus to spray glass wool insulation into the interior of said portable spa structure.

18. The portable spa of claim 17 wherein said process further comprises placing a bottom sheet over the spa bottom after the glass wool insulation has been installed to retain the installed glass wool in place.

19. The portable spa of claim 18 wherein said process further comprises installing batting material to seal selected openings in the interior of the spa structure prior to spraying the glass wool insulation into the interior of the portable spa structure.

20. The portable spa of claim 17 wherein said process further comprises installing batting material to seal selected openings in the interior of the spa structure prior to spraying the glass wool insulation into the interior of the portable spa structure.

21. A method of insulating a portable spa comprising:

inverting a portable spa having an open bottom surface;

providing a cover configured to cover said open bottom surface and having at least one opening therein;

inserting a glass wool spraying apparatus into said opening; and employing said apparatus to spray glass wool insulation into the interior of said portable spa.

22. The method of claim 21 further comprising placing a bottom sheet over the spa bottom after the glass wool insulation has been installed to retain the installed glass wool in place.

23. The method of claim 22 further comprising installing batting material to seal selected openings in the interior of the spa structure prior to spraying said glass wool insulation into the interior of said portable spa.

24. The method of claim 23 wherein the selected openings sealed by the batting material comprise firewall openings.

25. The method of claim 21 further comprising installing batting material to seal selected openings in the interior of the spa structure prior to spraying said glass wool insulation into the interior of said portable spa.

26. Apparatus comprising:

a portable spa having a spa shell, framing around the shell, and spa equipment installed within said framing;

insulation applied within the framing in the interior of the spa and about the spa equipment, the insulation comprising removable sprayed-in glass wool;

batting material sealing selected openings in the interior of said spa, a plurality of the selected openings comprising firewall openings; and a cover attached to the bottom of the spa and configured to hold the sprayed-in glass wool in place in the interior of the spa.

27. A method of insulating a portable spa comprising:

inverting the portable spa;

providing a sealing plate comprising plurality of pivotally mounted openable doors each positioned so as to reside over a selected interior cavity of said spa;

installing batting material to seal selected openings in the interior of the spa structure;

lowering said sealing plate onto an open bottom surface of the inverted spa such that said sealing plate is positioned adjacent a space in said interior into which the glass wool is to be installed so as to confine the glass wool insulation to the interior of the portable spa during installation of the glass wool;

selectively opening each of said plurality of doors;

successively inserting a glass wool installation apparatus into an opening revealed when each door is opened;

employing said apparatus to install glass wool through each opening of said sealing plate;

lifting said sealing plate off of the portable spa structure; and placing a horizontally oriented bottom sheet over the open spa bottom surface of the portable spa structure after the glass wool insulation has been installed to retain the installed glass wool insulation in place.

28. The method of claim 27 wherein the selected openings sealed by said batting material prior to lowering said sealing plate comprise firewall openings.

29. The method of claim 28 wherein a said door is opened by pivoting it in a plane parallel to that of a horizontal sealing plate surface.

30. The method of claim 1 further comprising lifting the sealing plate off of the spa.

* * * * *